United States Patent [19]

Viola

[11] Patent Number: 4,575,465

[45] Date of Patent: Mar. 11, 1986

[54] INK JET TRANSPARENCY

[75] Inventor: Michael S. Viola, Burlington, Mass.

[73] Assignee: Polaroid Corporation, Cambridge, Mass.

[21] Appl. No.: 681,264

[22] Filed: Dec. 13, 1984

[51] Int. Cl.[4] ..... B41M 5/00

[52] U.S. Cl. ..... 427/261; 346/1.1; 346/135.1; 400/126; 428/195; 428/478.2; 428/480; 428/481; 428/483; 428/500; 428/522; 428/532

[58] Field of Search ..... 346/135.1; 427/261, 427/288; 428/206, 207, 211, 483, 500, 325, 331, 475.2, 478.2, 480, 481, 195, 522, 532, 913, 914; 400/126

[56] References Cited

U.S. PATENT DOCUMENTS 4,308,542 12/1981 Maekawa et al. ..... 346/135.1
4,460,637 7/1984 Miyamoto et al. ..... 428/323

*Primary Examiner*—Bruce H. Hess

[57] ABSTRACT

An ink jet recording sheet comprising a transparent support carrying a layer comprising up to 50% by weight of vinylpyridine/vinylbenzyl quaternary salt copolymer and a hydrophilic polymer selected from the group consisting of gelatin, polyvinyl alcohol and hydroxypropyl cellulose and mixtures thereof.

10 Claims, No Drawings

INK JET TRANSPARENCY

BACKGROUND OF THE INVENTION

Ink jet printing refers to a method of forming type characters on a paper by ejecting ink droplets from a printhead from one or more nozzles. Several schemes are utilized to control the deposition of the ink droplets on the printing substrate or recording sheet to form the desired characters. For example, one method comprises deflecting electrically-charged droplets by electrostatic means. Another method comprises the ejection of single droplets under the control of a piezoelectric device. One type of ink employed is the so-called non-drying type which functions by quickly penetrating the substrate, e.g., paper fibers, thus giving the appearance of being dry to the touch even though still possessing a quantity of relatively low vapor pressure solvent. Another widely used type of ink are aqueous inks, that is, inks which are composed of a relatively large quantity of water which functions as the solvent and carrier for the dyes therein. Aqueous inks, however, suffer from the deficiency of lack of stability to moisture, i.e., poor water-resistance on the printed substrate which causes loss of resolution in the image. This can occur even when the printed records are stored in areas of relatively high humidity.

The image generated by an ink jet printing device may be either in the form of a reflection print wherein the image is deposited on a substantially opaque reflective substrate for example, when the image is formed on a sheet such as paper or may comprise a transparency, that is, when the image is formed on a substantially transparent recording substrate and is viewed by illuminating the side of the substrate opposite the image side and viewing from the image side. Such material is, of course, particularly advantageous for use in viewing by projection.

Since projection of a transparency generally involves enlarging of the image, it will be seen that the image quality requirements are more stringent for a transparency than for an image viewed by reflection. Of course a transparency must take into consideration the other problems which may be common to both the transparency and to the reflection image, for example, the water fastness problem discussed above when aqueous inks are employed.

U.S. Pat. No. 4,269,981 issued May 26, 1981 is directed to a recording sheet for ink jet recording which can be viewed under both reflected and transmitted light and which comprises a support and an ink-absorbing layer provided on said support wherein said ink absorbing layer comprises a white pigment having ink-absorbing abilities and a binder resin possessing film-forming ability. As examples of suitable white pigments, mention is made of clay, talc, diatomaceous earth, calcium carbonate, titanium dioxide and the like. As examples of suitable binder materials, mention is made of oxidized starch, etherified starch, gelatin, casein, hydroxyethyl cellulose, polyvinyl alcohol and the like.

See also Japanese Pat. No. 5614583 and German Pat. No. 3,024,205 for other disclosures of polyvinyl alcohol as a binder for pigments, such as calcium carbonate or micropowders such as silicic acid.

Generally, when used alone, a layer of polyvinyl alcohol is not suitable as a receptor layer for ink jet recording systems employing aqueous based inks. Such layers are often too tacky after receiving the ink.

SUMMARY OF THE INVENTION

The present invention is directed to a printing substrate adapted to produce transparencies, which comprises an ink jet recording sheet comprising a transparent support carrying a layer comprising up to 50% by weight of a vinylpyridine/vinylbenzyl quaternary salt copolymer and a hydrophilic polymer selected from the group consisting of gelatin, polyvinyl alcohol land hydroxypropyl cellulose, and mixtures thereof.

DETAILED DESCRIPTION OF THE INVENTION

The present invention is directed to a printing substrate for use with inks which are predominantly water-based. The terms "water-based inks" and "aqueous inks" as used herein are intended to refer to ink compositions wherein the solvent or carrier liquid is at least about 50% water by weight. In addition to water and dyes or pigments, such inks also typically contain humectants, organic solvents, detergents, thickeners, preservatives and the like.

It has now been found that by employing as a receptor layer for use in an ink jet printing process a layer comprising up to 50% by weight of a vinylpyridine/vinylbenzyl quaternary salt copolymer and a specified hydrophilic polymer, significantly improved performance in terms of increased density, water and light fastness drying time and dot spreading are obtained.

The preparation of the vinyl pyridine/vinylbenzyl quaternary salt copolymers and specific copolymers are disclosed in U.S. Pat. No. 4,340,522, issued July 20, 1982, incorporated herein by reference. The copolymerizable vinyl benzyl ammonium salt is represented by the formula:

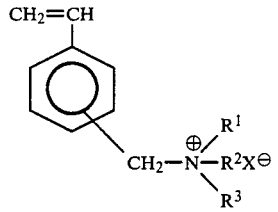

wherein each of $R^1$, $R^2$ and $R^3$ is independently alkyl; substituted alkyl; cycloalkyl; aryl; aralkyl; alkaryl, or at least two or $R^1$, $R^2$ and $R^3$ together with the quaternary nitrogen atom to which they are bonded complete a saturated or unsaturated, substituted or unsubstituted nitrogen-containing heterocyclic ring.

The vinylpyridine comonomer employed in the present invention can comprise any of the pyridine having a vinylic substituents. Thus, 2-vinylpyridine, 3-vinylpyridine, 4-vinylpyridine can be used, as well as alkyl substituted pyridines.

It is surprising that the copolymer employed in the present invention is useful in forming ink jet transparencies since, when coated alone, an unacceptable hazy layer is produced. By employing one of the specified hydrophilic polymers at a level of at least 50%, a haze-free product is obtained with superior properties for producing ink jet transparencies.

Hydrophilic polymers useful in the present invention, include gelatin, polyvinyl alcohol, hydroxypropyl alcohol and mixtures thereof. Care should be taken in the selection of a hydrophilic polymer to avoid use of an incompatible polymer which could cause haze.

In a particularly preferred embodiment, a 50-50 mixture, by weight, of 4-vinylpyridine/vinylbenzyl trimethyl ammonium chloride copolymer and polyvinyl alcohol is employed. It has also been found that relatively large amounts of fully hydrolyzed polyvinyl alcohol when blended with the copolymer has been found to function satisfactorily even with, for example, an ink with a 50% water content.

In an alternative embodiment, the polyvinyl alcohol layer may include up to about 0.3% by weight, based on the weight of the polyvinyl alcohol of particulate material less than about 25 micrometers in size. Such materials enhance the antiblocking characteristics of the recording sheet particularly after it has been printed on without adversely effecting the transparent characteristics of the sheet. As examples of suitable particulate materials, mention may be made of silica, glass beads and polytetrafluoroethylene particles.

The novel transparency materials of the present invention were prepared by coating the polymer on a 4 mil transparent polyester base, drying and then evaluating using a Canon Model A-1210 Ink Jet Printer with a water-based ink containing glycerine and at least 50% water. Evaluation of the print included degree of dot spreading and time of drying. The following Table sets forth formulations which possessed sufficient dot spreading characteristics to form a character without gaps and was dry to the touch, i.e., did not smear, in about 10 seconds. Coverage of the polymer was about 1000 mg/ft$^2$.

TABLE

| | % by weight |
|---|---|
| 1. 4-vinylpyridine/vinylbenzyl trimethyl ammonium chloride copolymer (3:1) | 25 |
| Polyvinyl alcohol (GELVATOL 20-90, 87% hydrolysis, sold by Monsanto Company, St. Louis, MO) | 75 |
| 2. 4-vinylpyridine/vinylbenzyl trimethyl ammonium chloride copolymer (3:1) | 50 |
| Gelatin | 50 |
| 3. 4-vinylpyridine/vinylbenzyl trimethyl ammonium chloride copolymer (3:1) | 40 |
| Polyvinyl alcohol (GELVATOL 20-90, 87% hydrolysis, sold by Monsanto Company, St. Louis, MO) | 60 |
| 4. 4-vinylpyridine/vinylbenzyl trimethyl ammonium chloride copolymer (3:1) | 10 |
| Polyvinyl alcohol (GELVATOL 20-90, 87% hydrolysis, sold by Monsanto Company, St. Louis, MO) | 90 |
| 5. 4-vinylpyridine/vinylbenzyl trimethyl ammonium chloride copolymer (3:1) | 22.5 |
| Polyvinyl alcohol (GELVATOL 20-90, 87% hydrolysis, sold by Monsanto Company, St. Louis, MO) | 67.5 |
| Nonionic surfactant [nonylphenoxypoly-(ethylenoxy) ethanol, sold by GAF Corp. New York, NY under the tradename IGEAAL 630] | 10 |
| 6. 4-vinylpyridine/vinylbenzyl trimethyl ammonium chloride copolymer (3:1) | 50 |
| Polyvinyl alcohol (ELVANOL 70-30, 99.8% hydrolysis, sold by E. I. DuPont de Namours Co., Wilmington, DE) | 50 |
| 7. 4-vinylpyridine/vinylbenzyl trimethyl ammonium chloride copolymer (3:1) | 25 |
| Polyvinyl alcohol (GELVATOL 20-90, 87% hydrolysis, sold by Monsanto Company, St. Louis, MO) | 75 |
| Glycerine | 5% by weight based on the total solids |
| 8. 4-vinylpyridine/vinylbenzyl trimethyl ammonium chloride copolymer (3:1) | 50 |
| Hydroxypropyl cellulose (CLUCEL EF sold by Hercules, Inc. Wilmington, DE) | 50 |

It should also be understood that the layer carried on the transparent support can also include such addenda as ultraviolet absorbers, antioxidants, surfactants, humectants, bacteriostat and cross-linking agents.

The support employed in the present invention is not critical. Polymeric films of both synthetic and those derived from naturally occurring materials may be employed. As examples of suitable transparent polymeric materials, mention may be made of polymethacrylic acid; methyl and ethyl esters; polyamides, such as nylons; polyesters, such as the polymeric films derived from ethylene glycol terephthalate acid; polymer cellulose derivitives; polycarbonates; polystyrene and the like. To promote adhesion, subcoats or surface treatments such as corona discharge may be employed.

What is claimed is:

1. A transparent ink jet recording sheet comprising a transparent support carrying a layer comprising up to 50% by weight of a vinylpyridine/vinylbenzyl quaternary salt copolymer and a hydrophilic polymer selected from the group consisting of gelatin, polyvinyl alcohol, hydroxypropyl cellulose and mixtures thereof.

2. The product of claim 1 wherein said vinylpyridine is 4-vinylpyridine.

3. The product of claim 1 wherein said vinylbenzyl quaternary salt is trimethyl vinylbenzyl ammonium chloride.

4. The product of claim 1 wherein said hydrophilic polymer is gelatin.

5. The product of claim 1 wherein said hydrophilic polymer is polyvinyl alcohol.

6. The product of claim 1 wherein said hydrophilic polymer is hydroxypropyl cellulose.

7. The product of claim 5 wherein said polyvinyl alcohol is fully hydrolyzed.

8. The product of claim 1 wherein said copolymer and said hydrophilic polymer are each 50% by weight.

9. The product of claim 1 wherein said copolymer and said hydrophilic polymer are 25% and 75%, by weight, respectively.

10. The method of ink jet printing which comprises contacting a transparent recording sheet with at least one stream of droplets generated from an ink jet printer, wherein said recording sheet comprises a transparent support carrying a layer comprising up to 50% by weight of a vinylpyridine/vinylbenzyl quaternary salt copolymer and a hydrophilic polymer selected from the group consisting of gelatin, polyvinyl alcohol, and hydroxypropyl alcohol and mixtures thereof.

* * * * *